US006684838B2

(12) United States Patent
Pluta et al.

(10) Patent No.: US 6,684,838 B2
(45) Date of Patent: Feb. 3, 2004

(54) TAPPET

(75) Inventors: Barbara Pluta, Eggolsheim (DE); Stefan Dorn, Hollfeld (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/077,075

(22) Filed: Feb. 15, 2002

(65) Prior Publication Data

US 2002/0157628 A1 Oct. 31, 2002

(30) Foreign Application Priority Data

Feb. 15, 2001 (DE) ..... 101 06 983

(51) Int. Cl.[7] ..... F01L 1/14

(52) U.S. Cl. ..... 123/90.48; 123/90.49; 123/90.5

(58) Field of Search ..... 123/90.48, 90.49, 123/90.5

(56) References Cited

U.S. PATENT DOCUMENTS

| | | | | |
|---|---|---|---|---|
| 4,615,440 A | * | 10/1986 | Downing | 206/229 |
| 5,081,976 A | * | 1/1992 | Dahm et al. | 123/90.48 |
| 5,226,389 A | * | 7/1993 | Buuck | 123/90.48 |
| 5,267,538 A | * | 12/1993 | Speil et al. | 123/90.48 |
| 5,280,771 A | * | 1/1994 | Groh et al. | 123/90.51 |
| 5,365,897 A | * | 11/1994 | Speil et al. | 123/90.52 |
| 5,664,530 A | * | 9/1997 | Ammon et al. | 123/90.51 |
| 5,870,985 A | * | 2/1999 | Bretting | 123/90.55 |
| 5,954,020 A | * | 9/1999 | Schmidt et al. | 123/90.48 |
| 5,979,385 A | * | 11/1999 | Speil et al. | 123/90.55 |

FOREIGN PATENT DOCUMENTS

| | | |
|---|---|---|
| DE | 4340035 A1 | 6/1994 |
| EP | 516962 A1 | 12/1992 |
| WO | WO 9500749 | 1/1995 |

OTHER PUBLICATIONS

Patent Abstracts of Japan—Pub. No. 11324618 A Nov. 26, 1999.

Patent Abstracts of Japan—Pub. No. 2000110523 A Apr. 18, 2000.

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A tappet (1) for the transfer of a lifting motion to a sliding part is provided having two parts, including a circular shaped section (2) with a base (5) connected to it as one piece and a separate dome-shaped socket (9) connected to the base (5) made of thin-walled material with a contact surface (10) for the sliding part. The tappet (1), whose socket (9) extends over a considerable length of the circular shaped section (2), can be economically manufactured.

5 Claims, 1 Drawing Sheet

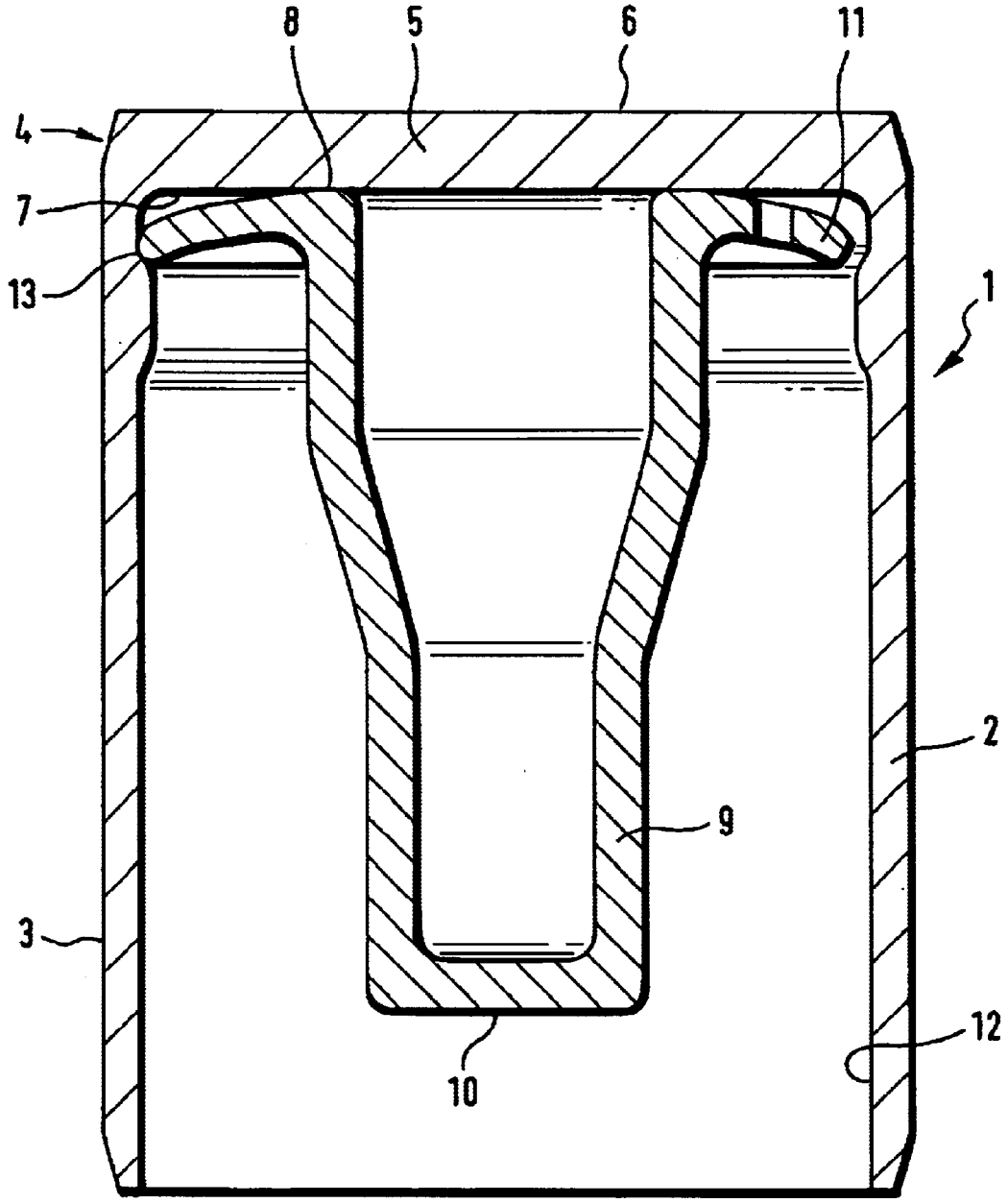
8
5
6
11
4
7
13
1
2
9
3
12
10

TAPPET

BACKGROUND

The invention concerns a tappet especially for transferring a cam or eccentric generated oscillating movement onto a sliding part such as a gas exchange valve or a pump piston, which has a circular-shaped section, which includes an outer casing for guiding in form and a base on the top, the outer side of which provides the contact area for the cam. A dome-shaped socket with a contact surface for the sliding part extends from the inner side of the base.

A tappet of this type is disclosed in FIG. 13 of the WO 95/00749. This possesses a circular-shaped section which has a one-piece dome-shaped socket extending from the topside into the interior. A separate base is secured to the topside of the socket.

The disadvantage of this construction is that the one-piece construction of the circular-shaped section with the dome-shaped socket is very difficult to manufacture, considering the current state of technology in the field. The length of the socket alone is limited by manufacturing and technical considerations. Attaching a separate base to the socket securely also presents difficulties in itself.

There is a multitude of uses, for example, in tappet bodies for valve drives in internal combustion engines or for tappets for pump pistons in injection pumps or similar devices, in which a relatively long socket is required for the interior of the tappet because of the construction proportions. But for this there is no known solution that is also economical to manufacture with the current state of technology. Indeed there are extruded bucket tappets that are more closely detailed, for example, and which are constructed in one piece with a base and a dome-shaped socket, but this socket can only feature a small and therefore insufficient length due to manufacturing, technical, and cost limitations.

SUMMARY

The object of the invention is therefore to create a tappet of the kind described above, for which the disadvantages indicated are eliminated by simple means.

By this invention, the problem is solved by manufacturing the circular-shaped section in one piece with the base, so that the dome-shaped socket is constructed as a separate component and is secured to the inner side of the base or to an inner surface of the circular-shaped section in the area of its end face near the base.

This therefore makes it economical to manufacture the "body material" for the tappet, which can then be bound easily to the socket and is adjustable with regard to height. Because of the separate construction of the dome-shaped socket, the manufacturing costs are significantly lower in comparison to the previously noted solutions, and the device can also be varied as indicated for clearance adjustment regarding height.

The socket should preferably be formed of a light-weight construction material such as sheet metal and be constructed in a hollow cylindrical manner.

Simple solutions for connecting the socket to the tappet body are the topic of further discussion below. It is recommended, for example, to furnish the socket with a ring collar in the area of its end face facing the base, and to construct this ring collar as a spring component with optional clasps. Thus, the socket can be connected by means of the spring with a latch joint to the inner surface of the circular section. As an alternative, provision can be made for connecting the ring collar by means of caulking or welding to the inner surface or the inner side of the base.

The ring collar may also be totally rejected and the end face of the socket simply caulked, welded, or soldered in the area of the base.

The thin walled construction of the socket, in accordance with requirements, guarantees a small mass for the tappet, which has an advantageous effect, for example, on the oscillating masses in the valve drive. It is also conceivable, however, to have a more massive or semi-massive socket.

Naturally, there are even more possibilities available to those skilled in the art for binding the end face of the socket or the ring collar to the tappet body, such as stamping, rolling, bonding and similar methods.

BRIEF DESCRIPTION OF THE DRAWING

The function of the invention is described in more detail in connection with of the drawing. The single illustration shows a longitudinal cross-section through a tappet, here for contact of a pump piston in an injection pump for fuel of either a quality or quantity controlled internal combustion engine.

DETAILED DESCRIPTION OF THE PREFERRED EMBODIMENT

FIG. 1 shows a tappet (1) for a use such as that noted in the previous paragraph. This tappet (1) can, however, also be utilized for movement of a gas exchange valve in an internal combustion engine. The tappet (1) has a circular section (2) with an outer casing (3). By means of this construction, the tappet (1) is incorporated into a longitudinal guide not displayed here. In the top area (4), the tappet (1) includes a base (5) having a disk-like geometry. The base (5) has an outer top side (6). This serves as a contact face for an eccentric or cam, not illustrated here. The base (5) also has an inner side (7). On this lies a dome-shaped socket (9) with a ring-shaped end face (8). The socket (9) extends along a large part of the length of the circular-shaped section (2) and has a contact surface (10) for a pump piston on the end furthest from the base. If the tappet (1) is used in the valve drive of an internal combustion engine, a gas exchange valve stem would be located at the contact surface (10).

As can easily ascertained from the illustration, the circular shaped section (2) and the base (5) are manufactured in one piece, for example, in an extrusion mold or a sheet metal forming procedure. The socket (9) is constructed as a separate component and is found of a thin walled material such as sheet metal.

From the end face (8) of the socket (9), a ring collar (11) extends in the direction of the inner surface (12) of the circular section (2). Through the ring collar (11), the socket (9) may be simply mounted onto the inner surface (12) of the circular section (2).

The ring collar (11) is preferebly constructed as a spring component and has tongue-like sections, for example, by means of which it is attached by friction-fit or form-fit with its outer ring (13) onto the inner surface (12). It is also possible, however, to connect it by stamping or welding.

By varying the height of the socket (9), a clearance adjustment can be made when installed. This can also be realized in combination with the thickness of the base (5), of course. It is also possible to manufacture the socket (9) from a man-made material or a similar appropriate material, and if needed, strengthen it with fibers or particles.

| | |
|---|---|
| 1 | Tappet |
| 2 | Section |
| 3 | Outer Casing |
| 4 | Top Area |
| 5 | Base |
| 6 | Outer Side |
| 7 | Inner Side |
| 8 | End Face |
| 9 | Socket |
| 10 | Contact Surface |
| 11 | Ring Collar |
| 12 | Inner Surface |
| 13 | Outer Ring |

What is claimed is:

1. Tappet for transferring a cam or eccentric generated oscillating movement onto a sliding part such as a gas exchange valve or a pump piston, the tappet comprising a circular-shaped section (2), having an outer casing (3) for guiding movement and a base (5) on a top area (4) of the outer casing, the base having an outer side (6) which includes a contact area for the cam, and a dome-shaped socket (9) with a contact surface (10) for the sliding part extends away from an inner side (7) of the base, the circular section (2) is manufactured in one piece with the base (5), and the dome-shaped socket (9) is constructed as a separate component and is secured in an area of an end face (8) thereof which faces the inner side (7) of the base within an inner surface (12) of the circular section (2), the circular-shaped section has a height and the socket (9) is longer than half of the height of the circular-shaped section (2), the end face (8) of the socket (9) has a ring collar (11) which secures the socket (9) to the tappet (1), and the collar and the socket are integrally formed as a one piece, thin walled construction from sheet material.

2. Tappet in accordance with claim 1, wherein the ring collar (11) is constructed as a spring component and is secured by latching an outer ring (13) thereof to the inner surface (12).

3. Tappet in accordance with claim 2, wherein the ring collar (11) comprises tongue-like sections.

4. Tappet in accordance with claim 1, wherein the ring collar (11) is secured by caulking to the inner surface (12) of the circular shaped section (2).

5. Tappet in accordance with claim 1, wherein the ring collar (11) is connected into the inner easing surface (12) of the circular shaped section (2) with a welded or soldered bond.

* * * * *